United States Patent [19]

Kobari et al.

[11] Patent Number: 4,681,535

[45] Date of Patent: Jul. 21, 1987

[54] PREHEATING MECHANISM FOR SOURCE METAL FOR MELT

[75] Inventors: Osamu Kobari, Funabashi; Takashi Kida, Yachiyo, both of Japan

[73] Assignee: Toho Development Engineering Co., Ltd., Tokyo, Japan

[21] Appl. No.: 856,924

[22] Filed: Apr. 28, 1986

[51] Int. Cl.[4] ..... F27D 19/00

[52] U.S. Cl. ..... 432/48; 432/57; 432/49; 432/72; 432/157

[58] Field of Search ..... 432/57, 78, 73, 48, 432/49, 72, 157

[56] References Cited

U.S. PATENT DOCUMENTS

| | | | |
|---|---|---|---|
| 3,379,424 | 4/1968 | Dell'Agnese et al. | 432/57 |
| 3,554,508 | 1/1971 | Dell'Agnese | 432/57 |
| 3,837,791 | 9/1974 | Schoch et al. | 432/48 |
| 4,375,958 | 3/1983 | Date et al. | 432/72 |

FOREIGN PATENT DOCUMENTS

| | | |
|---|---|---|
| 59-63486 | 4/1984 | Japan . |
| 59-200185 | 11/1984 | Japan . |

*Primary Examiner*—Henry C. Yuen

*Attorney, Agent, or Firm*—Martin A. Farber

[57] ABSTRACT

A preheating mechanism for preheating a source metal for melt includes a combination of independent combustion and preheating devices. The mechanism also includes a high-temperature gas conduit for connecting the combustion device and the preheating device, a low-temperature gas conduit for connecting the preheating device and an exhaust gas chimney, a branch pipe branched from the low-temperature gas conduit and connected to the high-temperature gas conduit, and a short-cut gas conduit for connecting a conduit portion at a combustion device side from a coupling portion between the high-temperature gas conduit and the branch pipe to a conduit portion at an exhaust gas chimney side from a branch portion between the low-temperature gas conduit and the branch pipe. A diluting mechanism is arranged in the short-cut gas conduit. A valve with a variable motor is arranged in the branch pipe. A temperature sensor is arranged between the preheating device and the coupling portion between the high-temperature gas conduit and the branch pipe. The valve controls gas flow in the branch pipe in response to a signal from the temperature sensor.

11 Claims, 6 Drawing Figures

PREHEATING MECHANISM FOR SOURCE METAL FOR MELT

BACKGROUND OF THE INVENTION

The present invention relates to a mechanism for preheating a source metal for a melt and, more particularly, to a preheating mechanism having a combination of independent combustion and preheating devices and suitable for heating and melting of nonferrous metals such as aluminum and zinc.

Most recent nonferrous metal melting furnaces use a combusted exhaust gas to preheat a melt source for the purpose of energy saving. In a conventional melting furnace of this type, a heat exchanger is used to heat primary or secondary combustion air by a high-temperature combusted exhaust gas, thereby decreasing the fuel expense. However, in a typical example of the conventional nonferrous metal melting furnace, a leading portion of a gas flue of the melting furnace is utilized as a source charging/prehating portion. For example, in melting of aluminum scraps and die cast recycle materials, most of the melting furnaces with a preheating chamber used as source preheating type melting furnaces or fast melting furnaces are exemplified by a melting furnace shown in FIG. 1.

Referring to FIG. 1, a preheating tower 2 made of the same refractory wall as the melting furnace extends upward from the peripheral portion of the upper surface of a reverberatory furnace 1. The preheating tower 2 also serves as a gas flue and has an exhaust port 3 at its upper portion. A source for a melt such as scraps is charged from a charging port 4 at the top and drops downward through the preheating tower 2 by its own weight. The scraps are heated by the exhaust gas rising from the lower side. The source is melted by a high-temperature combustion gas from a melting burner 6 at a chute-like melting portion 5 having a lower inclined portion below the preheating tower 2. The melt in the furnace is heated by a heating burner 6'. In the melting furnace with this structure, the temperature of the exhaust gas is excessively high, and the gas path in the preheating tower is eccentric. Only the source along the gas path tends to be locally overheated and melted, and most of the exhaust gas is exhausted without being used to heat the source. As a result, the effective heat conduction area of the charged source is decreased, and heat utilization is degraded. Furthermore, a high-temperature molten metal in the preheating stage increases an excessive oxidation loss of the metal and an evaporation loss. As a result, the yield of melt is decreased.

SUMMARY OF THE INVENTION

It is, therefore, a principal object of the present invention to control the temperature and pressure of a preheating gas on the basis of operating conditions of a combustion device for supplying the preheating gas and a preheating device during preheating of a source metal for a melt, thereby allowing stable preheating.

It is another object of the present invention to effectively utilize heat energy of the combustion device to preheat the source metal.

It is still another object of the present invention to increase a yield of a melt of the source metal.

It is still another object of the present invention to provide a source preheating mechanism which can be easily applied to an existing metal melting furnace.

In order to achieve the above objects of the present invention, there is provided a preheating mechanism having a combination of independent combustion and preheating devices, the preheating mechanism comprising a high-temperature gas conduit for connecting a combustion device, particularly a metal melting furnace to the preheating device, a low-temperature gas conduit for connecting the preheating device to an exhaust gas chimney, a branch pipe branched from the low-temperature gas conduit to communicate with the high-temperature gas conduit, and a short-cut gas conduit for directly establishing a short-cut between a high-temperature gas conduit portion of a combustion device side from a coupling portion between the high-temperature gas conduit and the branch pipe and a low-temperature gas conduit portion of an exhaust gas chimney side from a branch portion between the low-temperature gas conduit and the branch pipe, the short-cut gas conduit being provided with air diluting means for diluting a gas flow with air in a short-cut portion, the branch pipe being provided with gas flow control means for controlling a gas flow in the branch pipe between response to a signal from a temperature sensor arranged in the preheating device and the coupling portion between the high-temperature gas conduit and the branch pipe, another gas flow control means being arranged between the short-cut gas conduit and the branch portion between the low-temperature gas conduit and the branch pipe, and being operated in response to a signal from a temperature sensor arranged in the low-temperature gas conduit or the preheating device, or a signal from a pressure difference sensor for detecting a difference between a pressure in a conduit between the preheating device and the coupling portion between the high-temperature gas conduit and the branch pipe and a pressure in a conduit between the preheating device and the coupling portion between the low-temperature gas conduit and the branch pipe.

The above and other objects, features and advantages of the present invention will be apparent from the following detailed description in conjunction with the accompanying drawings.

DETAILED DESCRIPTION OF THE PREFERRED EMBODIMENTS

Preheating mechanisms according to preferred embodiments of the present invention will be described with reference to FIGS. 2, 3 and 4.

Figure 1:
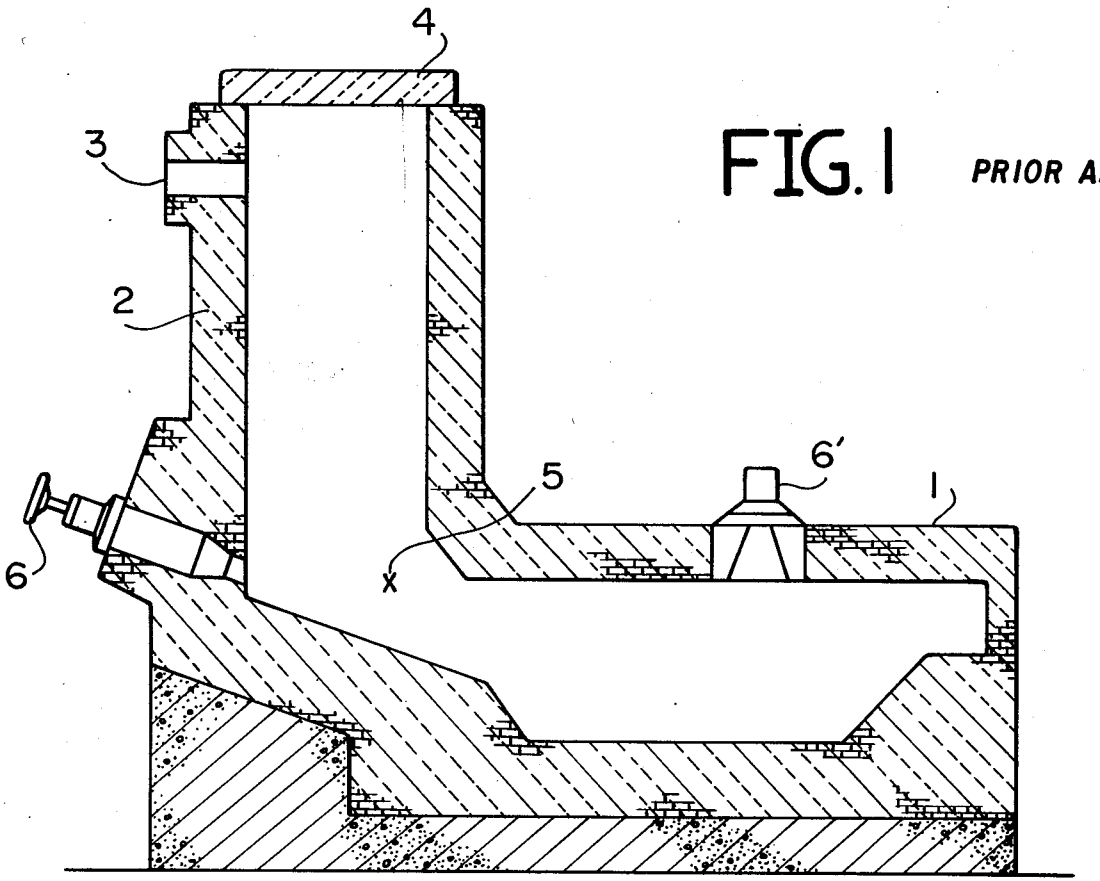
FIG. 1 PRIOR ART
FIG. 1 is a schematic sectional view showing a conventional melting furnace with a preheating tower.
Figure 2:
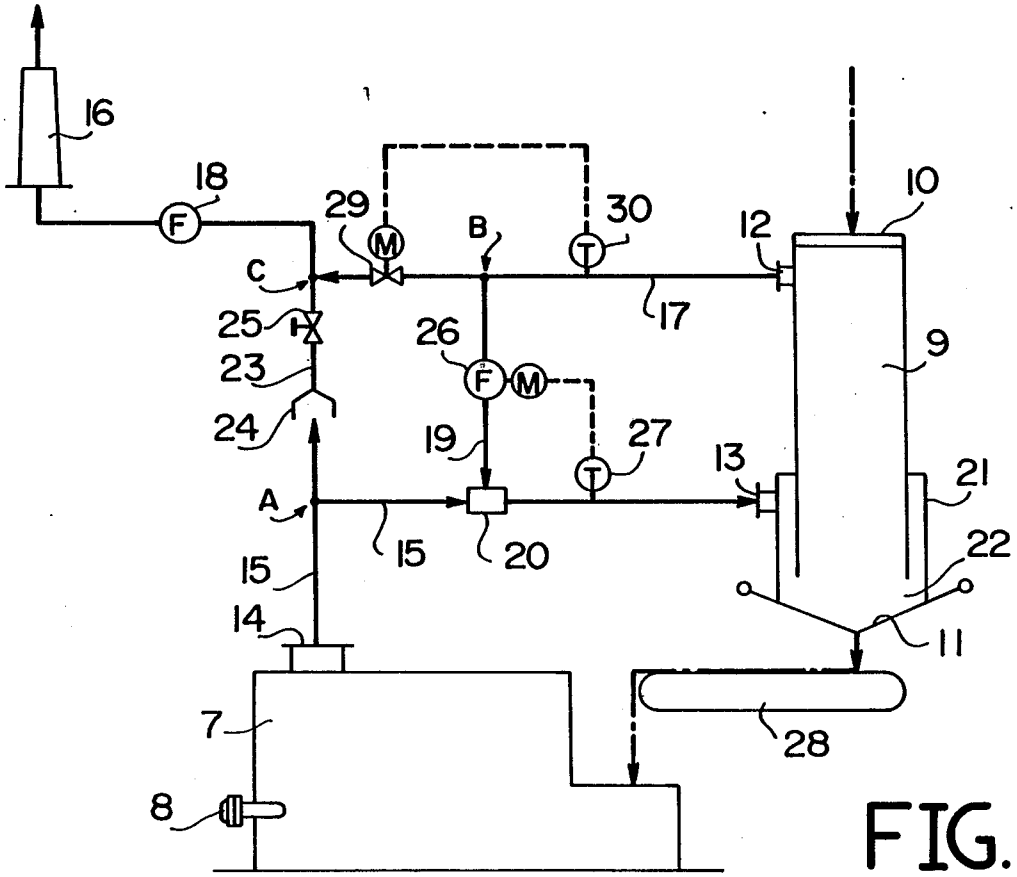
FIG. 2 is a system diagram showing a preheating mechanism according to an embodiment of the present invention.
Figure 3:
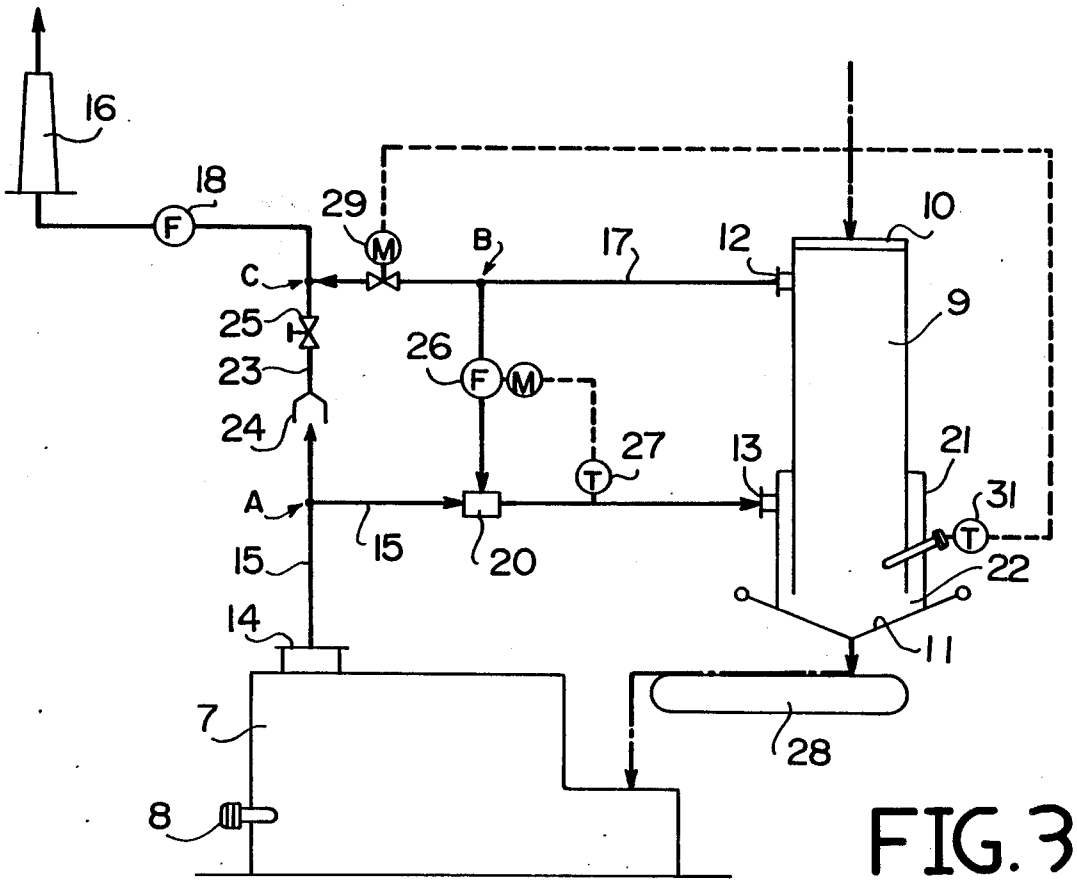
FIGS. 3 and 4 are system diagrams showing preheating mechanisms according to other embodiments of the present invention.
Figure 4:
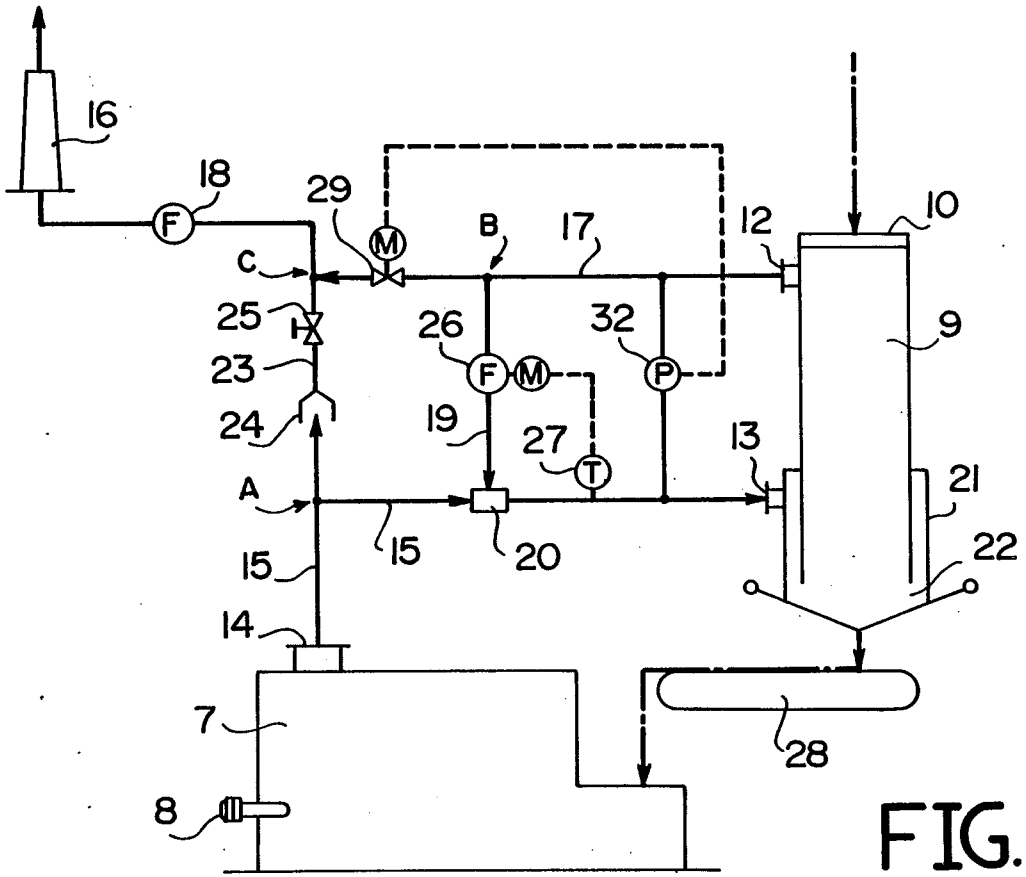

FIG. 2 shows a preheating mechanism according to an embodiment of the present invention, and FIGS. 3 and 4 show preheating mechanisms according to other embodiments thereof.

Referring to FIGS. 2 to 4, in each preheating mechanism, a metal melting furnace 7 is exemplified as a combustion device. The melting furnace 7 is a normal open well type melting furnace for melting aluminum or the like. The melt inside the furnace 7 is heated by a burner 8 to a predetermined temperature. The combustion device of the present invention may be constituted by another combustion device for generating a heating gas. However, a metal melting furnace has an advantage in that an exhaust gas is used to preheat a source metal.

A preheating furnace 9 is a preheating device arranged separately from the melting furnace 7. The preheating furnace 9 is preferably of a tower type, and must be of a type wherein a source metal is charged from the upper portion, drops inside the furnace while being preheated by the preheating gas, and exhausted from the lower portion. The preheating furnace 9 has a source charging port 10 at the top portion and a damper 11 in the bottom portion. An exhaust port 12 is formed at the upper portion of the furnace, and a skirt-like blow box 21 is formed around the lower wall portions of the furnace. A gas inlet port 13 is open to the blow box 21. A gas can be uniformly blown from a large number of gas supply holes 22 to the entire space of the lower portion of the furnace. The gas supply holes 22 are formed in the bottom wall of the furnace.

A high-temperature gas conduit 15 with a heat-insulating function is connected between an exhaust port 14 of the melting furnace 7 and the gas inlet port 13. A low-temperature gas conduit 17 is connected to the exhaust port 12 of the preheating furnace 9 and an exhaust gas chimney 16. An exhaust fan 18 is preferably arranged at a position near the chimney 16 of the low-temperature gas conduit 17. The low-temperature gas conduit 17 is branched at a position midway therealong, and a branch pipe 19 thereof is coupled to the high-temperature gas conduit 15. A mixer 20 which is arranged at the coupling portion mixes the high-temperature gas from the melting furnace and the low-temperature gas bypassed from the preheating furnace through the branch pipe 19 to supply a uniform heating gas flow to the heating furnace 9. The mixing mechanism can be arbitrarily selected.

Figure 5A:
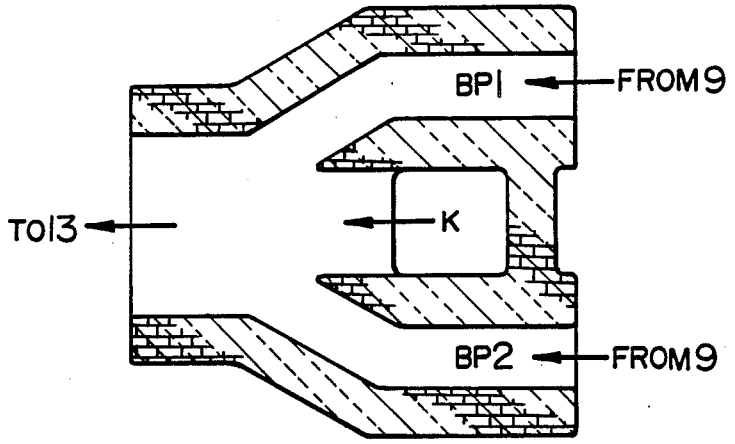
FIGS. 5A and 5B are sectional views showing a modification of the embodiments of the present invention.
Figure 5B:
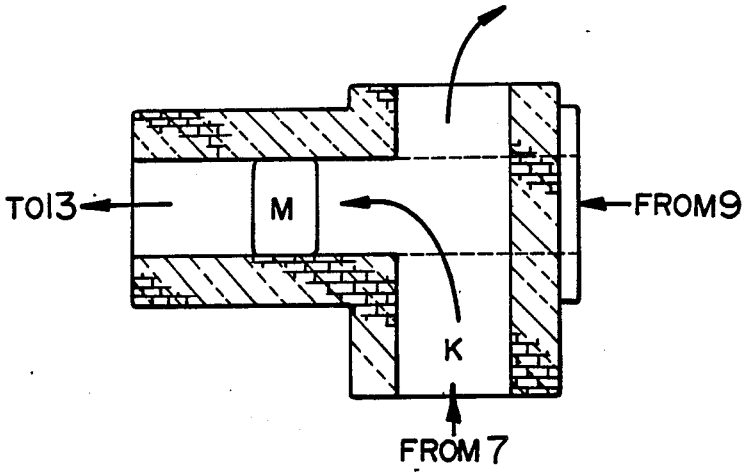

In order to directly exhaust the high-temperature gas from the melting furnace 7 to the exhaust gas chimney 16 without passing through the preheating furnace 9, a high-temperature gas conduit portion A at the side of the combustion device (i.e, the melting furnace 7) with respect to the coupling portion (i.e., the mixer 20) between the high-temperature gas conduit 15 and the branch pipe 19 is directly coupled to a low-temperature conduit portion C at the side of the exhaust gas chimney 16 with respect to a branch portion B between the low-temperature gas conduit 17 and the branch pipe 19. This coupling between the conduit portions A and C is made by a short-cut gas pipe 23. However, if the mixer 20 has a conduit for directly supplying an excess high-temperature gas from the melting furnace 7 to the short-cut gas conduit 23, the short-cut gas conduit 23 can be branched from the mixer 20. In this case, the mixer 20 is shifted to the coupling portion A. As shown in FIGS. 5A and 5B, the high-temperature gas from the melting furnace 7 through a lower central portion K of the mixer is mixed with the low-temperature gas from the the preheating furnace 9 through two side paths BP1 and BP2 at a point M of the mixer. A mixed gas is supplied to the gas inlet port 13. A diluting means 24 and a flow control means 25 such as a valve are arranged in the short-cut gas conduit 23 to dilute and cool the high-temperature gas from the melting furnace 7 by means of a cooling gas such as air. The diluting means 24 may have a simple structure wherein the conduit 23 is disconnected, and a hood-like reception port is formed on the open end of the conduit 23 at the downstream side (chimney side).

With the mechanism of the present invention, in addition to piping, flow control means such as a fan 26 with a variable motor, a valve with a motor or an actuating valve are arranged in the branch pipe 19. A temperature sensor 27 is arranged in a mixed gas flow portion of the high-temperature gas conduit 15 between the mixer 20 and the preheating furnace 9. When the mixed gas temperature in the conduit 15 is higher or lower than a predetermined temperature, the temperature sensor 27 generates a detection signal. The flow control means (i.e., the fan 26) is operated in response to the detection signal to increase or decrease the low-temperature gas flow. This flow control means is known to those skilled in the art.

In each of the preheating mechanisms of FIGS. 2 to 4, the melt is heated by the burner 8 inside the melting furnace 7. The preheated source from the preheating furnace 9 is charged in the melting furnace 7 by a feeder 28 or a chute through the damper 11 located at the bottom of the preheating furnace 9 and is brought into direct contact with the melt. The preheated source is thus melted by the melt. The heating gas in the melting furnace is fed from the exhaust port 14 and reaches the preheating furnace 9 through the high-temperature gas conduit 15 and the mixer 20. The heating gas is then blown in the furnace through the gas inlet port 13, the blow box 21 and the gas supply holes 22. The high-temperature gas blown in the furnace rises while heating the source. The gas as a low-temperature exhaust gas is then exhausted from the exhaust port 12 in air through the low-temperature gas conduit 17, the fan 18 and the exhaust gas chimney 16. The exhaust gas from the chimney is preferably treated by an anti-pollution device such as a dust collector, and the clean gas is exhausted in air.

When the temperature of the preheating gas supplied to the preheating furnace, i.e., the temperature at the mixed gas flow portion of the high-temperature gas conduit 15 exceeds a predetermined upper temperature limit, the temperature sensor 27 generates a signal to increase the rotational speed of the fan 26 in the branch pipe 19. The amount of the low-temperature gas returning to the preheating furnace 9 through the branch pipe 19 and the mixer 20 is increased, so that the temperature in the preheating furnace is decreased to the predetermined temperature. In this case, the high-temperature gas from the melting furnace 7 is not directed toward the preheating furnace 9 but exhausted as excess gas from the exhaust gas chimney 16 through the short-cut gas conduit 23, thereby further decreasing the temperature of the preheating gas.

However, when the temperature of the preheating gas is decreased below a predetermined lower temperature limit, the temperature sensor 27 arranged in the mixed preheating gas flow portion between the mixer 20 and the preheating furnace 9 generates a detection singal to decrease the rotational speed of the variable motor of the fan 26 in the branch pipe 19. The flow of the low-temperature gas is decreased, and the flow of the high-temperature gas from the melting furnace 7 is increased. As a result, the preheating gas temperature elevates. In the mechanism of the present invention, the temperature of the preheating furnace and the pressure in the preheating furnace circulating system are effectively controlled upon detection of the predetermined upper and lower temperature limits of the preheating mixed gas and operation of the fan 26 with a variable motor in the branch pipe 19 and the direct exhausting means for exhausting the gas through the short-cut gas conduit 23.

In the above mechanism, preheating gas temperature and pressure can be controlled. However, the system from the exhaust port 12 of the preheating furnace to the exhaust gas chimney 16 is open to the outer atmosphere. The load of the fan 26 for controlling the return gas flow of the branch pipe 19 is high. The pulsation of the preheating gas temperature and pressure often becomes an issue. When source conditions vary, this problem typically occurs. According to the present invention, however, gas flow control in the branch pipe 19 can be precisely performed by controlling exhaust of the low-temperature gas from the preheating furnace 9 to the exhaust gas chimney 16, thereby further stabilizing the preheating gas temperature and pressure. For this purpose, a valve 29 with a motor or an air actuated valve can be arranged as a gas flow control means between the branch portion B (between the low-temperature gas conduit 17 and the branch pipe 19) and the coupling portion C (between the low-temperature gas conduit 17 and the short-cut gas conduit 23). The opening/closing control of the valve 29 can be arbitrarily performed. However, preferably, (1) a temperature sensor 30 (FIG. 2) is arranged in the low-temperature gas conduit 17 between the exhaust port 12 of the preheating furnace and the branch portion B of the branch pipe 19; (2) a temperature sensor 31 (FIG. 3) is arranged in the preheating furnace 9; or (3) a pressure difference sensor 32 (FIG. 4) is arranged to detect a difference between the gas pressure in the low-temperature gas conduit 17 between the exhaust port 12 and the branch portion B of the branch pipe 19 and the gas pressure in a mixed gas flow portion in the high-temperature gas conduit 15 between the mixer 20 and the gas inlet port 13 of the preheating chamber.

In the first embodiment, when the used low-temperature gas temperature from the preheating furnace 9 exceeds the predetermined upper temperature limit of the temperature sensor 30, the opening of the valve 29 is decreased in response to the signal from the temperature sensor 30. The low-temperature gas flow directed toward the exhaust gas chimney 16 is decreased, and the gas flow returning through the branch pipe 19 is increased. This indicates that the pressure in a circulation gas system through the preheating furnace 9 and the branch pipe 19 is increased. Mixing in of the high-temperature gas from the melting furnace 7 with the low-temperature gas is limited, so that the gas flow directed toward the exhaust gas chimney 16 through the short-cut gas conduit 23 is increased. When the temperature of the low-temperature gas conduit 17 is lower than the predetermined lower temperature limit of the temperature sensor 30, the opposite operations to those described above are performed.

The opening of the valve 29 in the low-temperature gas conduit 17 is interlocked with driving of the fan 26 in the branch pie 19, and an increase/decrease in preheating gas temperature and pressure is quickly compensated for, and the preheating gas state is further stabilized. In the second embodiment, the gas flow control of the valve 29 upon temperature detection of the temperature sensor 31 in the preheating furnace 9 is interlocked with the gas flow control of the fan 26 in the branch pipe 19 upon the temperature detection of the mixed gas. The same effect as in the first embodiment can be obtained.

In the third embodiment, the fact that the preheating gas temperature in the mixed gas flow portion of the high-temperature gas conduit 15 is high indicates the fact that the valve 29 in the low-temperature gas conduit 17 is open, and that the amount of the high-temperature gas flow from the melting furnace 7 in the mixed flow portion is large. As is apparent from a gas flow resistance of the charge in the preheating furnace 9, in this state, the gas pressure in the mixed gas flow portion is higher than that in the low-temperature gas conduit 17. When the pressure difference between the high-pressure gas conduit and the low-temperature gas conduit exceeds a predetermined upper pressure limit, the valve 29 is closed in response to a pressure difference signal from the pressure difference sensor 32. By interlocked operation with the exhaust operation of the fan 26 in the branch pipe 19 upon detection of the high temperature in the high-temperature gas conduit, the flow of high-temperature exhaust gas through the short-cut gas conduit 23 is increased, thereby decreasing the pressure difference. A decrease in pressure difference indicates an increase in the gas returned through the branch pipe 19. In this case, with a predetermined time lag, the valve 29 is opened again and an excessive decrease in temperature of mixed gas is prevented.

The preheating mechanism of the present invention properly controls the preheating gas temperature and pressure by returning the low-temperature gas from the branch pipe upon temperature detection of the preheating gas in the high-temperature gas conduit, and by gas pressure control utilizing the short-cut conduit directly coupling the melting furnace and the exhaust gas chimney. In practical applications, the load of the melting furnace does not coincide with that of the preheating furnace. However, in order to quickly compensate for the variations in conditions of the melting furnace and the preheating furnace, the high-temperature exhaust gas from the exhaust gas chimney is controlled by the gas flow control means in the low-temperature gas conduit. In other words, the high-temperature gas with substantial variations from the melting furnace is diluted with the low-temperature gas after being used to preheat the charge, in order to meet the variation of the temperature and the pressure of the high-temperature gas. Therefore, variations in exhaust gas temperature and amount due to variations in fuel consumption upon occurrence of operational variations are easily compensated. Stable and effective source preheating of various source materials can be performed, and thus melting operation of nonferrous metals can be stabilized. In addition, the melting energy can be effectively utilized, and the melt yield can be increased. The combusted material in the preheating furnace can be easily separated, and the preheating mechanism of the present invention can be easily applied to existing melting furnaces.

What is claimed is:

1. A preheating mechanism for preheating a source metal for melt in a combination of independent combustion and preheating devices, comprising: a high-temperature gas conduit for connecting said combustion device and said preheating device; a low-temperature gas conduit for connecting said preheating device and an exhaust gas chimney; a branch pipe branched from said low-temperature gas conduit at a branch portion and connected to said high-temperature gas conduit at a coupling portion; a short-cut gas conduit for connecting a portion of said high-temperature gas conduit at a combustion device side from said coupling portion to a portion of said low-temperature gas conduit at an exhaust gas chimney side from said branch portion; diluting means arranged in said short-cut gas conduit; first gas flow control means arranged in said branch pipe; and a first temperature sensor arranged between said preheating device and said coupling portion between said high-temperature gas conduit and said branch pipe, said first gas flow control means being adapted to control a gas flow in said branch pipe in response to a signal from said first temperature sensor.

2. A mechanism according to claim 1, wherein said first gas flow control means comprises a fan with a variable motor.

3. A mechanism according to claim 1, wherein said first gas flow control means comprises a valve with a motor or an air actuated valve.

4. A mechanism according to claim 1 further comprising second gas flow control means arranged between said branch portion and another coupling portion, said another coupling portion being between said low-temperature gas conduit and said short-cut gas conduit.

5. A mechanism according to claim 4, wherein said second gas flow control means is operated to control a gas flow in response to a signal from a second temperature sensor arranged in said low-temperature gas conduit.

6. A mechanism according to claim 4, wherein said second gas flow control means is operated to control a gas flow in response to a signal from a second temperature sensor arranged in said preheating device.

7. A mechanism according to claim 4, wherein said second gas flow control means is operated to control a gas flow in response to a signal from a pressure difference detector for detecting a pressure difference between a pressure in a conduit portion of said high-temperature gas conduit between said preheating device and said coupling portion between said high-temperature gas conduit and said branch pipe and a pressure in a portion of said low-temperature gas conduit between said preheating device and said branch portion between said low-temperature gas conduit and said branch pipe.

8. A mechanism according to claim 4, wherein said second gas flow control means comprises a fan with a variable motor.

9. A mechanism according to claim 4, wherein said second gas flow control means comprises a valve with a motor or an air actuated valve.

10. A mechanism according to claim 1, further comprising a fan arranged between said exhaust gas chimney and another coupling portion, said another coupling portion being between said low-temperature gas conduit and said short-cut gas conduit.

11. A mechanism according to claim 1, wherein said combustion device comprises a metal melting furnace.

* * * * *